US010413085B2

(12) United States Patent
Haut

(10) Patent No.: US 10,413,085 B2
(45) Date of Patent: Sep. 17, 2019

(54) ADJUSTING MECHANISM AND RELATED CHILD CARRIER

(71) Applicant: Wonderland Nurserygoods Company Limited, NT (HK)

(72) Inventor: Robert E. Haut, Merion Station, PA (US)

(73) Assignee: Wonderland Switzerland AG, Steinhausen (CH)

( * ) Notice: Subject to any disclaimer, the term of this patent is extended or adjusted under 35 U.S.C. 154(b) by 189 days.

(21) Appl. No.: 15/638,393

(22) Filed: Jun. 30, 2017

(65) Prior Publication Data

US 2017/0295950 A1 Oct. 19, 2017

Related U.S. Application Data

(62) Division of application No. 14/302,431, filed on Jun. 12, 2014, now Pat. No. 9,756,961.
(Continued)

(51) Int. Cl.
*A47D 1/00* (2006.01)
*A47D 1/10* (2006.01)
*A47D 13/02* (2006.01)

(52) U.S. Cl.
CPC ..... *A47D 1/006* (2013.01); *A47D 1/002* (2013.01); *A47D 1/008* (2013.01); *A47D 1/0081* (2017.05); *A47D 1/10* (2013.01); *A47D 13/02* (2013.01)

(58) Field of Classification Search
CPC ..... A47D 1/006; A47D 1/10; A47D 1/002; B60N 2/2821; B60N 2/2848; B60N 2/2875
See application file for complete search history.

(56) References Cited

U.S. PATENT DOCUMENTS 4,743,063 A 5/1988 Foster, Jr.
5,028,061 A 7/1991 Hawkes
(Continued)

FOREIGN PATENT DOCUMENTS

CN 2686459 Y 3/2005
CN 2794336 Y 7/2006
(Continued)

*Primary Examiner* — David R Dunn
*Assistant Examiner* — Tania Abraham
(74) *Attorney, Agent, or Firm* — Winston Hsu

(57) ABSTRACT

An adjusting mechanism includes a first engaging component, a second engaging component and a third engaging component is applied to a child carrier including a supporting component and a seating component. The first engaging component is detachably disposed on the supporting component. The second engaging component is disposed on the seating component. The third engaging component is movably located between the first engaging component and the second engaging component in a switchable manner. The second engaging component drives the third engaging component to move between a first position and a second position. The third engaging component moves to the first position to engage with the first engaging component so as to constrain relative movement between the seating component and the supporting component. The third engaging component moves to the second position to be separated from the first engaging component and the seating component can rotate relative to the supporting component.

11 Claims, 19 Drawing Sheets

Related U.S. Application Data

(60) Provisional application No. 61/963,678, filed on Dec. 11, 2013, provisional application No. 61/959,655, filed on Aug. 29, 2013, provisional application No. 61/957,824, filed on Jul. 12, 2013, provisional application No. 61/956,705, filed on Jun. 14, 2013.

(56) References Cited

U.S. PATENT DOCUMENTS

| | | | | |
|---|---|---|---|---|
| 5,364,137 | A | 11/1994 | Shimer | |
| 5,564,778 | A | 10/1996 | Shimer | |
| 5,772,279 | A | 6/1998 | Johnson, Jr. | |
| 5,951,102 | A | 9/1999 | Poulson | |
| 6,361,106 | B1 | 3/2002 | Huang | |
| 6,428,099 | B1 * | 8/2002 | Kain | B60N 2/2806 297/250.1 |
| 6,428,100 | B1 | 8/2002 | Kain | |
| 6,695,400 | B2 | 2/2004 | Washizuka | |
| 6,715,828 | B1 | 4/2004 | Cheng | |
| 6,938,861 | B1 | 9/2005 | Ballard | |
| 7,401,803 | B1 | 7/2008 | Lai | |
| 7,597,396 | B2 * | 10/2009 | Longenecker | B60N 2/2806 297/253 |
| D618,001 | S | 6/2010 | Bearup | |
| 7,770,970 | B2 * | 8/2010 | Hei | B60N 2/2806 297/256.12 |
| 8,186,757 | B2 * | 5/2012 | Duncan | B60N 2/2806 297/256.13 |
| 8,276,985 | B2 * | 10/2012 | Kho | A47D 1/10 280/47.38 |
| 8,419,559 | B2 | 4/2013 | Zhang | |
| 8,474,907 | B2 * | 7/2013 | Weber | B60N 2/2821 297/256.13 |
| 8,845,028 | B2 | 9/2014 | Miller | |
| 2008/0179923 | A1 | 7/2008 | Lake | |
| 2009/0001776 | A1 | 1/2009 | Bearup | |
| 2009/0045656 | A1 | 2/2009 | Chen | |
| 2009/0256323 | A1 | 10/2009 | Mostert | |
| 2009/0315374 | A1 | 12/2009 | Hu | |
| 2010/0181806 | A1 | 7/2010 | Hu | |
| 2011/0074187 | A1 | 3/2011 | Zhong | |
| 2011/0291389 | A1 | 12/2011 | Offord | |
| 2012/0261961 | A1 | 10/2012 | Heisey | |
| 2013/0076079 | A1 | 3/2013 | Wang | |
| 2013/0082455 | A1 | 4/2013 | Chen | |
| 2013/0214567 | A1 | 8/2013 | Miller | |
| 2014/0054939 | A1 | 2/2014 | Hu | |
| 2014/0061404 | A1 | 3/2014 | Xiao | |
| 2014/0292050 | A1 | 10/2014 | Chen | |
| 2014/0368006 | A1 | 12/2014 | Taylor | |

FOREIGN PATENT DOCUMENTS

| | | | |
|---|---|---|---|
| CN | 101193576 | A | 6/2008 |
| CN | 201104672 | Y | 8/2008 |
| CN | 201312666 | Y | 9/2009 |
| CN | 101606801 | A | 12/2009 |
| CN | 101669737 | A | 3/2010 |
| CN | 301274724 | S | 6/2010 |
| CN | 202184482 | U | 4/2012 |
| CN | 102462255 | A | 5/2012 |
| CN | 202457448 | U | 10/2012 |
| DE | 20 2007 005 977 | U1 | 9/2007 |
| DE | 10 2007 014 995 | A1 | 10/2008 |
| DE | 10 2009 034 552 | B3 | 2/2011 |
| EP | 0 228 158 | A2 | 7/1987 |
| GB | 2 449 999 | A | 12/2008 |
| WO | 2006130906 | A1 | 12/2006 |
| WO | 2007112883 | A2 | 10/2007 |
| WO | 2007112883 | A3 | 10/2007 |

* cited by examiner

ADJUSTING MECHANISM AND RELATED CHILD CARRIER

CROSS REFERENCE TO RELATED APPLICATIONS

This application is a divisional application of and claims the benefit of U.S. non-provisional application Ser. No. 14/302,431 filed Jun. 12, 2014, and is included herein by reference. The U.S. non-provisional application Ser. No. 14/302,431 claims the benefit of U.S. provisional application No. 61/956,705 (which was filed on Jun. 14, 2013), U.S. provisional application No. 61/957,824 (which was filed on Jul. 12, 2013), U.S. provisional application No. 61/959,655 (which was filed on Aug. 29, 2013), and U.S. provisional application No. 61/963,678 (which was filed on Dec. 11, 2013).

BACKGROUND OF THE INVENTION

1. Field of the Invention

The present invention relates to an adjusting mechanism and a related child carrier, and more particularly, to an adjusting mechanism and a related child carrier with multiple switchable modes and convenient operation.

2. Description of the Prior Art

A conventional child high chair is mostly suitable for children starting about six years old. A seat height of the child high chair can be adjusted to bring the child closer to the caregiver for encouraging interaction and convenient caregiving. The wheels are fixed to the feet of the child high chair to easily move the child high chair. The child high chair further disposes the tray on the seat, and toys and food can be put on the tray. However, the seat and the feet of the conventional child high chair are undetachably fixed to each other, an angle formed between the seat and the feet is a predetermined value, and an inclined angle of the seat cannot be adjusted according to ages and body size of the child.

SUMMARY OF THE INVENTION

The present invention provides an adjusting mechanism and a related child carrier with multiple switchable modes and convenient operation for solving above drawbacks.

According to the claimed invention, a child carrier includes a supporting component and a seating component, and the seating component is detachably assembled with the supporting component. An adjusting mechanism includes a first engaging component, a second engaging component and a third engaging component. The first engaging component is detachably disposed on the supporting component. The second engaging component is disposed on the seating component. The third engaging component is movably located between the first engaging component and the second engaging component in a switchable manner. The second engaging component is adapted to drive the third engaging component to move between a first position and a second position. The third engaging component moves to the first position to engage with the first engaging component, so as to constrain a relative movement between the seating component and the supporting component. The third engaging component further moves to the second position to be separated from the first engaging component, so that the seating component rotates relative to the supporting component via the adjusting mechanism.

According to the claimed invention, a first assembling component is disposed on the supporting component. The first engaging component comprises a second assembling component to movably assemble with the first assembling component. The seating component is fixed to the supporting component via assembly of the first assembling component and the second assembling component.

According to the claimed invention, an engaging slot is formed on the first engaging component. The third engaging component is at least one tooth structure connected to the second engaging component. The tooth structure of the third engaging component is engaged with the engaging slot since the second engaging component moves the third engaging component to the first position. The adjusting mechanism further includes a resilient component. Two ends of the resilient component are respectively connected to a seat body of the seating component and the second engaging component. The adjusting mechanism further includes a driving component movably disposed on a seat body of the seating component and connected to the second engaging component. The driving component is adapted to move relative to the seating component to drive the second engaging component, so as to switch the third engaging component between the first position and the second position. The adjusting mechanism further includes a connecting component connected between the driving component and the second engaging component. The driving component is adapted to drive the second engaging component via the connecting component.

According to the claimed invention, the first engaging component includes a first internal tooth structure, and the second engaging component includes a second internal tooth structure. The third engaging component is a locking gear movably disposed between the first internal tooth structure and the second internal tooth structure. The second internal tooth structure includes a constraining tooth. The locking gear of the third engaging component includes a constraining slot whereinside the constraining tooth is movably disposed. The third engaging component is switched to the first position to simultaneously engage with the first engaging component and the second engaging component. The adjusting mechanism further includes an elastic component, two ends of the elastic component are respectively connected to the third engaging component and the first engaging component.

According to the claimed invention, the adjusting mechanism further includes an actuating component slidably disposed between the second engaging component and the third engaging component. The actuating component is adapted to slide relative to the seating component, so as to separate the third engaging component from the second engaging component. The adjusting mechanism further includes a driving component movably disposed on the seating component and connected to the actuating component. The driving component is adapted to move relative to a seat body of the seating component, so as to shift the actuating component. The adjusting mechanism further includes a cable, two ends of the cable are respectively connected to the driving component and the actuating component. The actuating component is shifted by the driving component via the cable.

According to the claimed invention, the actuating component includes an inclined guiding structure having a first end and a second end opposite to each other. A width of the first end is greater than a width of the second end. The second engaging component includes a cone structure, and the inclined guiding structure slidably contacts against the cone structure. The first end of the inclined guiding structure contacts a bottom of the cone structure since the third engaging component is switched to the first position. The second end of the inclined guiding structure contact a top of the cone structure since the third engaging component is switched to the second position.

According to the claimed invention, the seating component further includes a rotary assembly, and the rotary assembly includes a rotating holder, a clamping component and a jointing component. The jointing component is disposed on a lateral side of the seating component. The rotating holder is connected to the jointing component via the clamping component and is suspended over the seating component. The clamping component is made of resilient material. The clamping component includes a plurality of first constraining portions with annular engagement, and the jointing component includes a plurality of second constraining portions with annular arrangement. The plurality of first constraining portions is accordingly engaged with the plurality of second constraining portions to adjust relative position between the clamping component and the jointing component.

According to the claimed invention, the child carrier includes a supporting component, a seating component and an adjusting mechanism. The seating component includes a seat body, and the seat body is adapted to detachably assemble with the supporting component. The adjusting mechanism includes a first engaging component, a second engaging component and a third engaging component. The first engaging component is detachably disposed on the supporting component. The second engaging component is disposed on the seating component. The third engaging component is movably located between the first engaging component and the second engaging component in a switchable manner. The second engaging component is adapted to drive the third engaging component to move between a first position and a second position. The third engaging component moves to the first position to engage with the first engaging component, so as to constrain a relative movement between the seating component and the supporting component. The third engaging component further moves to the second position to be separated from the first engaging component, so that the seating component rotates relative to the supporting component via the adjusting mechanism. The supporting component includes a lower supporting frame and an upper supporting frame, the upper supporting frame is slidably disposed on the lower supporting frame.

According to the claimed invention, the adjusting mechanism further includes a driving component movably disposed on the seat body and connected to the second engaging component. The driving component is adapted to move relative to the seat body to drive the second engaging component. The adjusting mechanism further includes a connecting component connected between the driving component and the second engaging component. The driving component is adapted to drive the second engaging component via the connecting component. The connecting component is a wire structure. Two ends of the wire structure are respectively connected to the driving component and the second engaging component. The second engaging component is driven by the driving component via the wire structure. The seating component further includes an arc base disposed below the seat body.

The present invention provides the detachable child carrier. The seating component of the child carrier includes two kinds of seat, such as the toddler seat and the infant seat. The user can assemble the seating component with the supporting component to form the child carrier according to actual demand. The seating component suitable for the toddler can stand on the supporting plane by the foldable feet. The seating component suitable for the infant can be put on the supporting plane by the arc base. The present invention further provides two types of adjusting mechanism. The seating component can stably pivot to the supporting component via the adjusting mechanism, and the adjusting mechanism can be controlled by single hand to easily adjust the inclined angle of the seating component relative to the supporting component.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
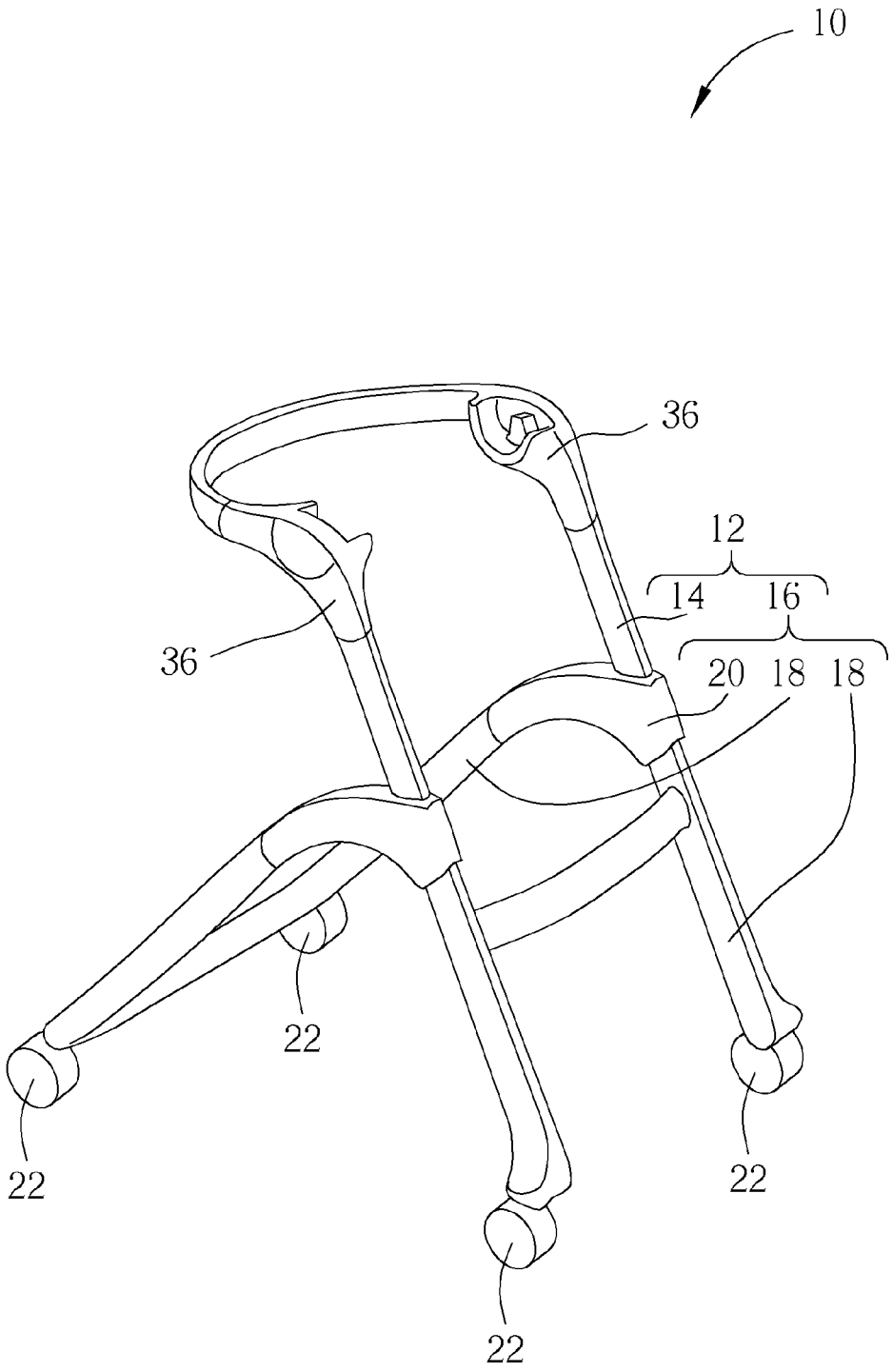
FIG. 1 is a diagram of a supporting component of a child carrier according to an embodiment of the present invention.

Please refer to FIG. 1. FIG. 1 is a diagram of a supporting component 12 of a child carrier 10 according to an embodiment of the present invention. The child carrier 10 includes a supporting component 12, which includes an upper supporting frame 14 and a lower supporting frame 16 that are slidably assembled with each other. The lower supporting frame 16 includes two frames 18. The front frame 18 is an H-shaped structure (located on a right side in FIG. 1), and the rear frame 18 is an U-shaped structure (located on a left side in FIG. 1). Two upper ends of the front frame 18 are connected with two upper ends of the rear frame 18 by a bridging component 20. Rollers 22 are disposed on two low ends of the front frame 18 and two low ends of the rear frame 18. The upper supporting frame 14 is slidably disposed on the frame 18 of the lower supporting frame 16 via the bridging component 20. The upper supporting frame 14 can slide relative to the lower supporting frame 16 to adjust a height of the seat (not shown in FIG. 1) since the supporting component 12 is utilized to support the seat.

Figure 2:
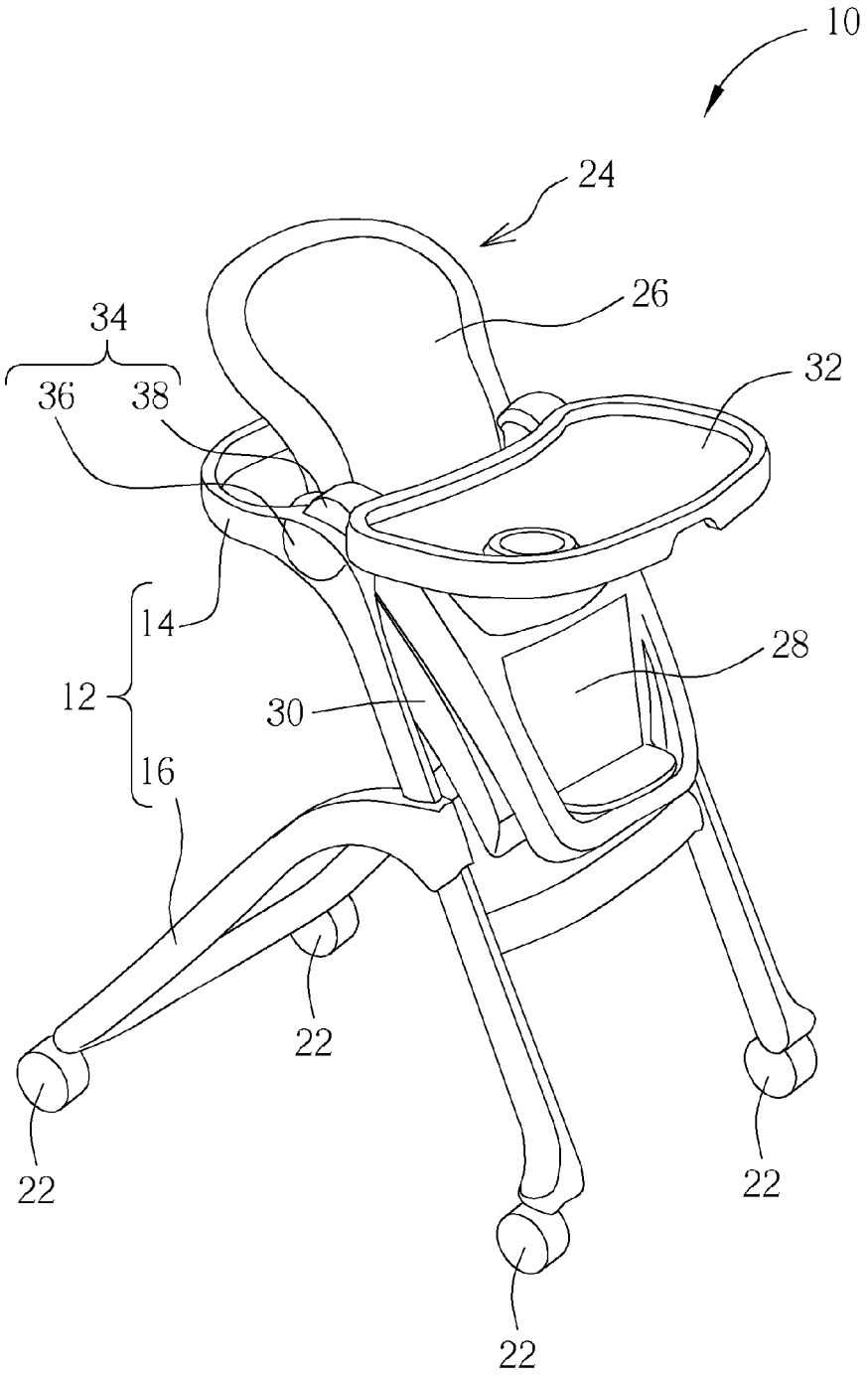
FIG. 2 is an assembly diagram of a supporting component and a seating component according to a first embodiment of the present invention.
Figure 3:
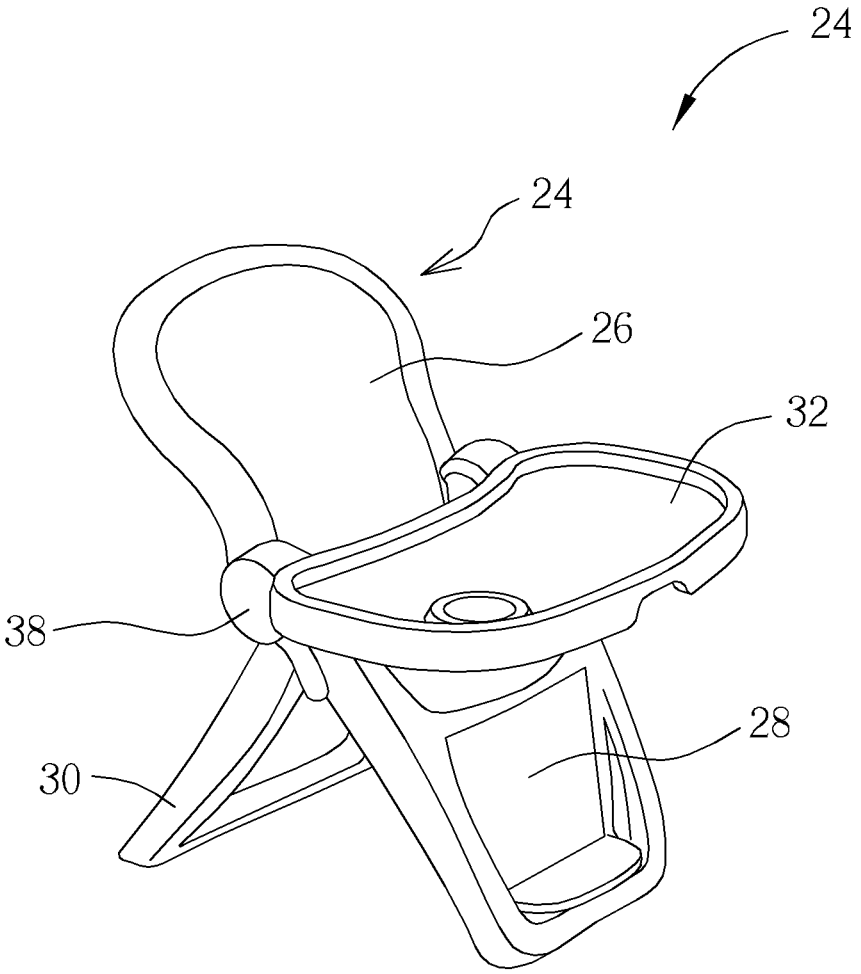
FIG. 3 is a diagram of the seating component in another mode according to the first embodiment of the present invention.

The child carrier 10 further includes a seating component 24 detachably assembled with the supporting component 12. The seating component 24 is a seat for a toddler or an infant. Please refer to FIG. 2 and FIG. 3. FIG. 2 is an assembly diagram of the supporting component 12 and the seating component 24 according to a first embodiment of the present invention. FIG. 3 is a diagram of the seating component 24 in another mode according to the first embodiment of the present invention. The seating component 24 includes a seat body 26, a first foot 28, a second foot 30 and a tray 32. The first foot 28 is fixed to the seat body 26, and the second foot 30 is pivotally disposed on the seat body 26. For assembly of the seating component 24 and the supporting component 12, the second foot 30 pivots relative to the seat body 26 to a first angle (such as an angle formed between the feet 28, 30 in parallel shown in FIG. 2), and the seating component 24 can be disposed on the supporting component 12 without structural interference. For independent application of the seating component 24, the seating component 24 is disassembled from the supporting component 12, the second foot 30 pivots relative to the seat body 26 to a second angle (such as an angle shown in FIG. 3), the second foot 30 can support the seat body 26 with the first foot 28, and the supporting component 24 can be stably put on a supporting plane (such as the table or the ground).

The child carrier 10 further includes a first engaging component 52 which including a second assembling component 38 detachably disposed on the supporting component 12. A first assembling component 36 is disposed on the supporting component 12. The first engaging component 52 can utilize the second assembling component 38 to movably assemble with the first assembling component 36. The seating component 24 is fixed on the supporting component 12 via assembly of the second assembling component 38 and the first assembling component 36. As shown in FIG. 1 and FIG. 2, the first assembling component 36 is a sunken arc body disposed on the upper supporting frame 14, to accommodate a part of the second assembling component 38. The second assembling component 38 is a sphere or disk body disposed on the first engaging component 52 of the seating component 24, to cover inner components and to accordingly assemble with the sunken arc body of the first assembling component 36.

In addition, the tray 32 is detachably disposed on the seat body 26. The user can decide whether the tray 32 is installed on the seat body 26 or not according to actual demand. The tray 32 is a selective accessory.

Figure 4:
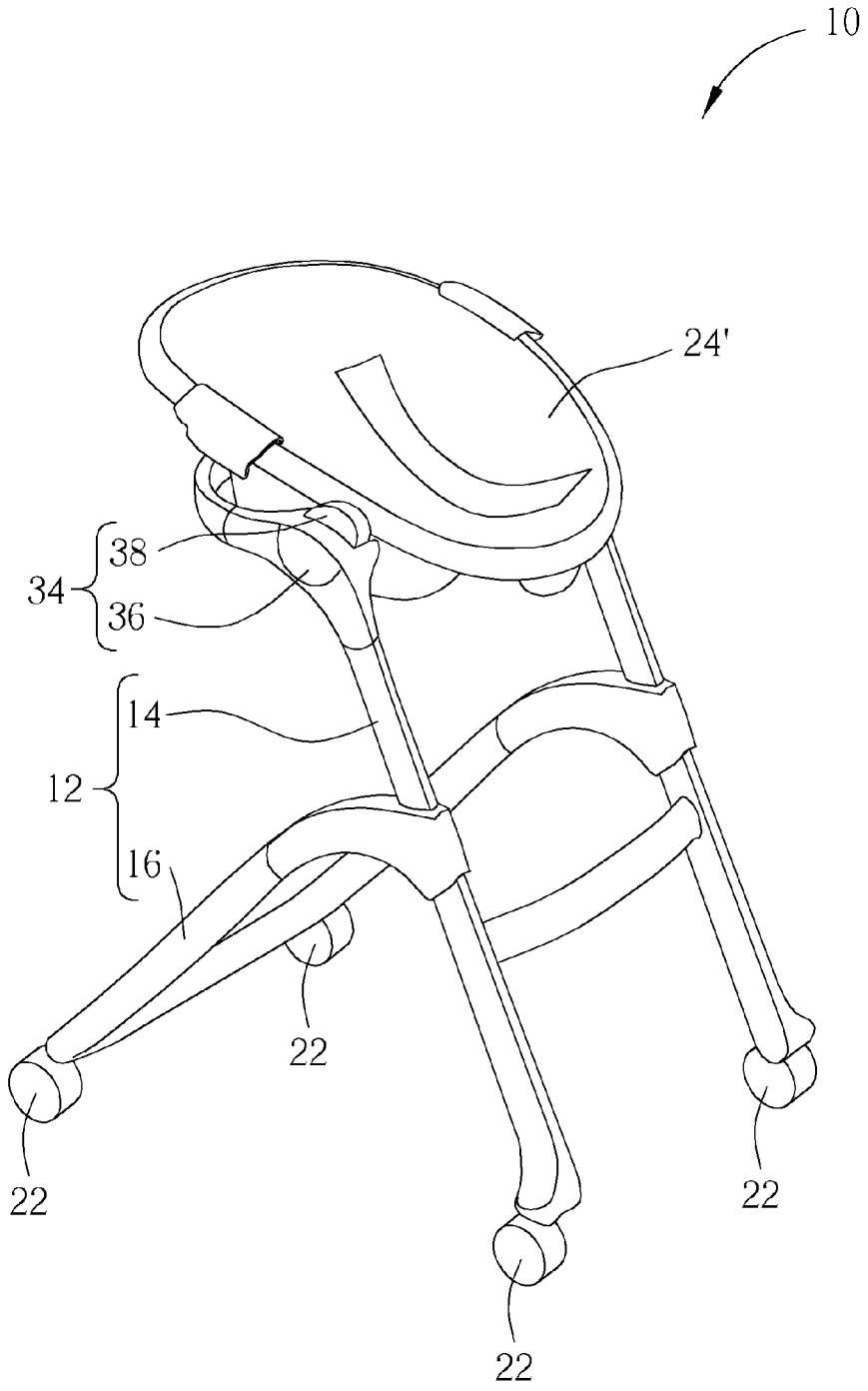
FIG. 4 is an assembly diagram of the supporting component and the seating component according to a second embodiment of the present invention.
Figure 5:
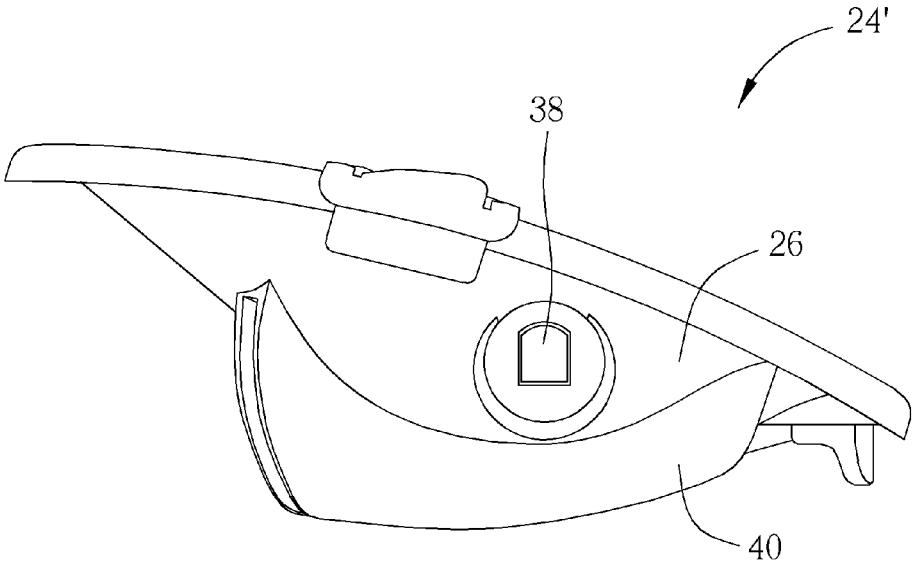
FIG. 5 is a diagram of the seating component according to the second embodiment of the present invention.

Please refer to FIG. 4 and FIG. 5. FIG. 4 is an assembly diagram of the supporting component 12 and the seating component 24' according to a second embodiment of the present invention. FIG. 5 is a diagram of the seating component 24' according to the second embodiment of the present invention. The seating component 24 of the first embodiment is a toddler seat, and the seating component 24' of the second embodiment is an infant seat. The seating component 24' includes the seat body 26, the second assembling component 38 and an arc base 40, without the feet and the tray. The arc base 40 is disposed below the seat body 26. The seat body 26 can be slightly wavered by the arc base 40 since the seating component 24' is put on the supporting plane (such as the table or the ground), which means the seating component 24' can generate periodic wave motion. The infant seat can be a rocking chair or a cradle.

Figure 6:
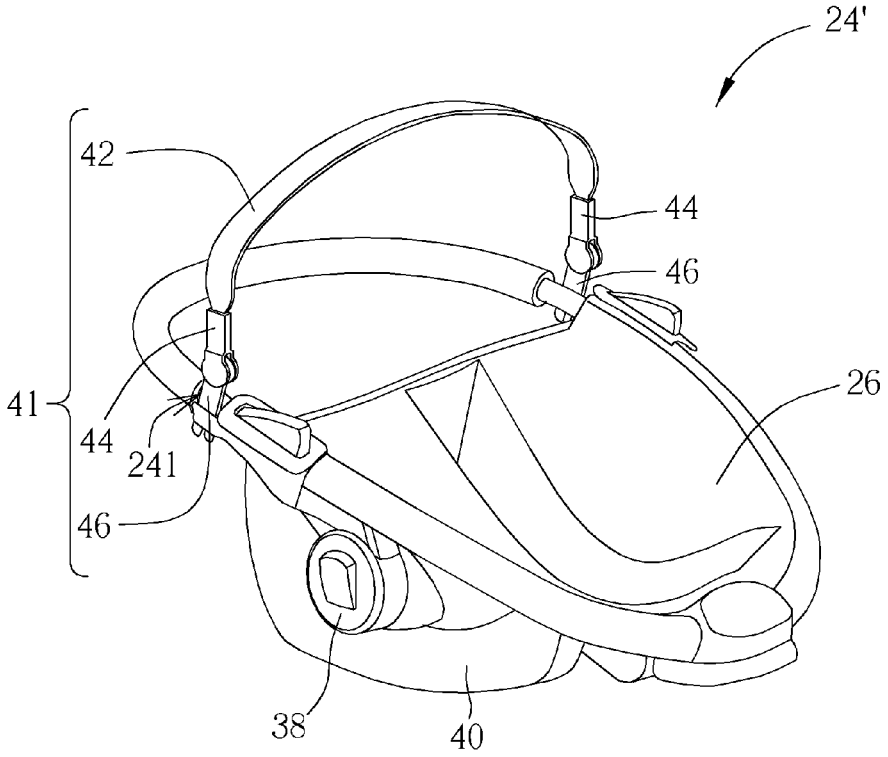
FIG. 6 is a diagram of the seating component in another mode according to the second embodiment of the present invention.
Figure 7:
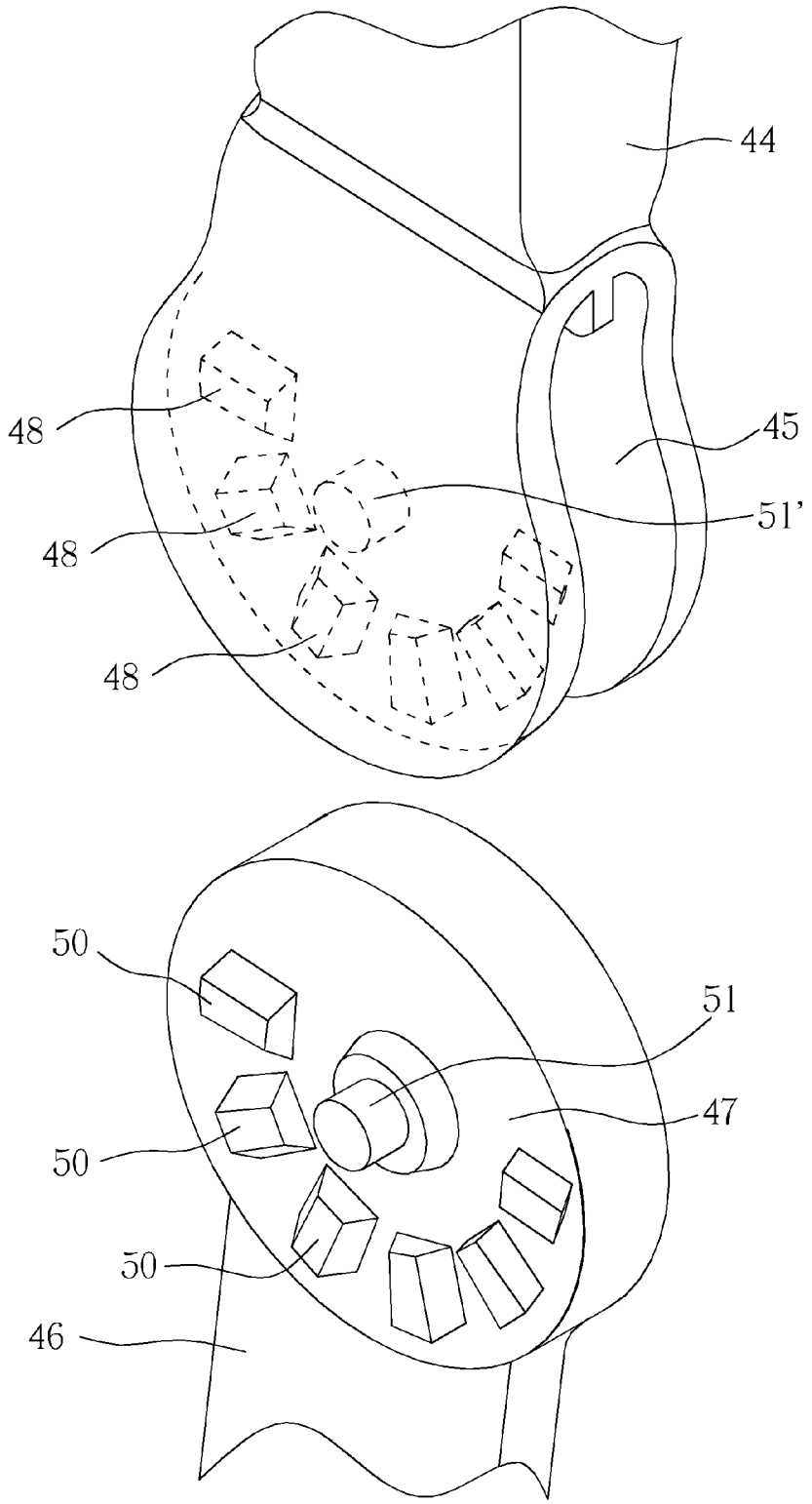
FIG. 7 is an exploded diagram of the seating component shown in FIG. 6.
Figure 8:
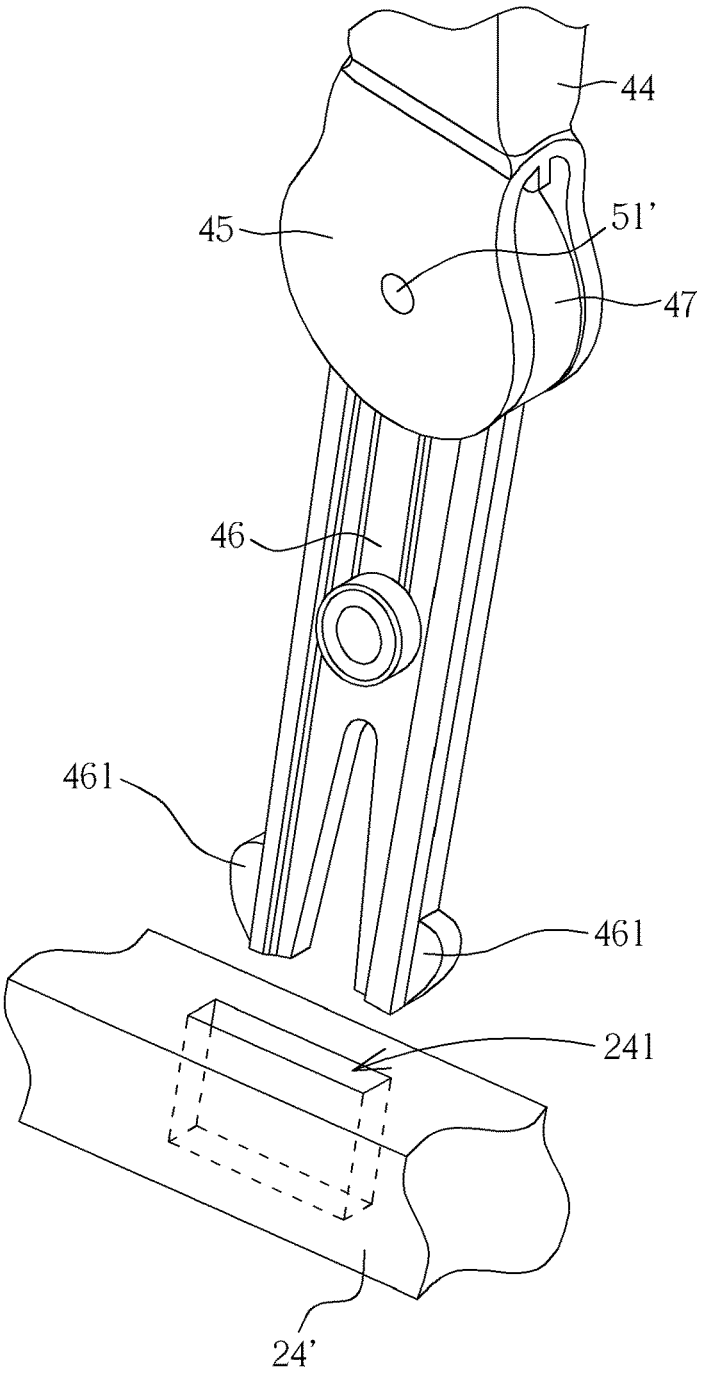
FIG. 8 is a diagram of a clamping component and a jointing component according to the second embodiment of the present invention.

Please refer to FIG. 6 to FIG. 8. FIG. 6 is a diagram of the seating component 24' in another mode according to the second embodiment of the present invention. FIG. 7 is an exploded diagram of a partial structure of the seating component 24' shown in FIG. 6. FIG. 8 is a diagram of a clamping component 44 and a jointing component 46 according to the second embodiment of the present invention. The seating component 24' further includes a rotary assembly 41, which includes a rotating holder 42, the clamping component 44 and the jointing component 46. Two ends of the rotating holder 42 are connected to the clamping components 44. The jointing component 46 is movably connected to the clamping component 44. The rotary assembly 41 is detachably disposed on two lateral sides of the seat body 26 via the jointing components 46. In an embodiment, the rotary assembly 41 is a toy handle, and toys are hanged on the rotating holder 42. In another embodiment, the rotary assembly 41 is utilized to be a canopy of the stroller or the safety car seat.

As shown in FIG. 7 and FIG. 8, at least one pin axle 51 is disposed on outer lateral walls 47 of the jointing component 46, and at least one pin slot 51' is accordingly disposed on inner lateral walls 45 of the clamping component 44. The clamping component 44 is connected to the jointing component 46 by an insertion of the pin axle 51 into the pin slot 51'. The clamping component 44 can rotate relative to the jointing component 46, but not limited to, by connection of the pin axle 51 and the pin slot 51'. For example, the pin axle 51 can be further disposed on the clamping component 44, and the pin slot 51' can be further disposed on the jointing component 46. The pin axle 51 can be integrated with the jointing component 46 (or the clamping component 44) monolithically. A plurality of first constraining portions 48 with annular arrangement is disposed on the inner lateral walls 45 of the clamping component 44. A plurality of second constraining portions 50 with annular arrangement is disposed on the outer lateral walls 47 of the jointing component 46. For example, the first constraining portion 48 can be a protrusion with an inclined surface, and the second constraining portion 50 can be a corresponding sunken slot for accommodating the protrusion. Structures of the constraining portions 48, 50 are not limited to the above-mentioned embodiment, and depend on design' demand. Each of the first constraining portions 48 can be arbitrarily engaged with the corresponding second constraining portion 50. The inclined surface is benefit to switch the first constraining portion 48 from one of the second constraining portions 50 to another. It should be mentioned that the clamping component 44 is preferably made of resilient material, such as plastic, to provide resilient recovering force as a metal spring. The resilient clamping component 44 can be an integrated spring to contributively engage the first constraining portions 48 of the clamping component 44 with the second constraining portions 50 of the jointing component 46, and further to rotate the clamping component 44 relative to the jointing component 46 by resilient engagement/disengagement of the first constraining portions 48 and the second constraining portions 50. For adjusting relative height between the rotating holder 42 and the seat body 26, the user can apply an external force to the rotating holder 42, the clamping component 44 is driven to generate resilient deformation, each of the first constraining portions 48 can move from the original second constraining portion 50 to the adjacent second constraining portion 50, and position variation (such as variation of the relative rotary angle) between the clamping component 44 and the jointing component 46 can be conveniently adjusted.

As shown in FIG. 8, the jointing component 46 further includes a plurality of fastening portions 461 disposed on the other end (the low end) of the jointing component 46 opposite to the second constraining portions 50 and the pin axles 51. The fastening portions 461 can be fastened on fastening slots 241 formed on the seating component 24'. The jointing component 46 preferably includes two fastening portions 461. The two fastening portions 461 stretch from the low end of the jointing component 46 in a resiliently deformable manner. A distance between free ends of the two fastening portions 461 is greater than a width of the fastening slot 241. The foresaid distance between the free ends of the fastening portions 461 can be decreased by an external force, and the free ends of the fastening portions 461 can be recovered to initial positions since the external force is removed. For installing the jointing component 46 on the seating component 24', the external force is applied to the two fastening portions 461, and the distance between the free ends of the fastening portions 461 is decreased to insert the fastening portions 461 into the fastening slot 241. The external force is removed since the fastening portions 461 insert into the fastening slot 241, the distance between the free ends of the fastening portions 461 is recovered to an initial value and the fastening portions 461 cannot be disengaged from the fastening slot 241.

Figure 9:
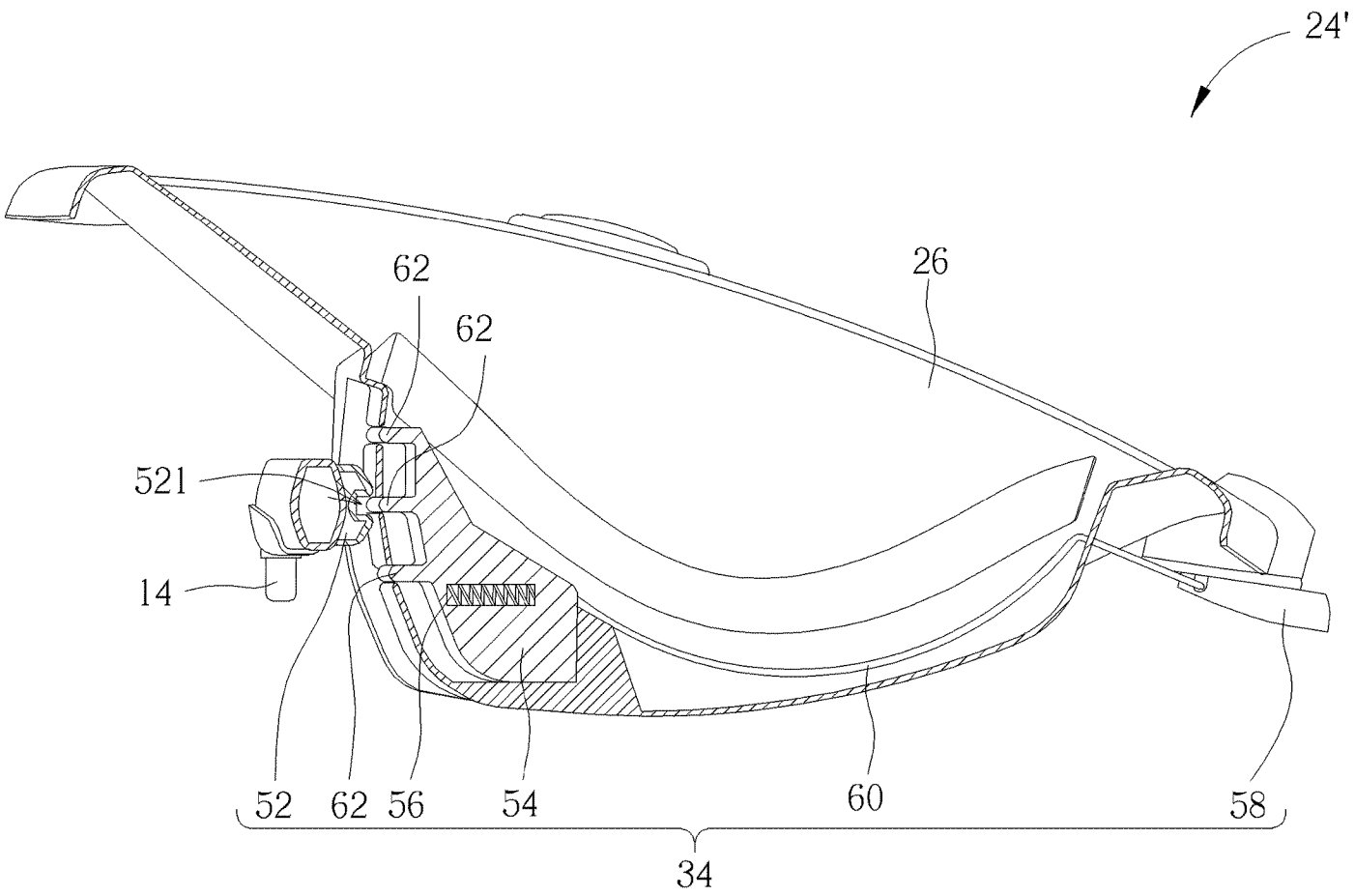
FIG. 9 is a sectional view of an adjusting mechanism according to a first embodiment of the present invention.
Figure 11:
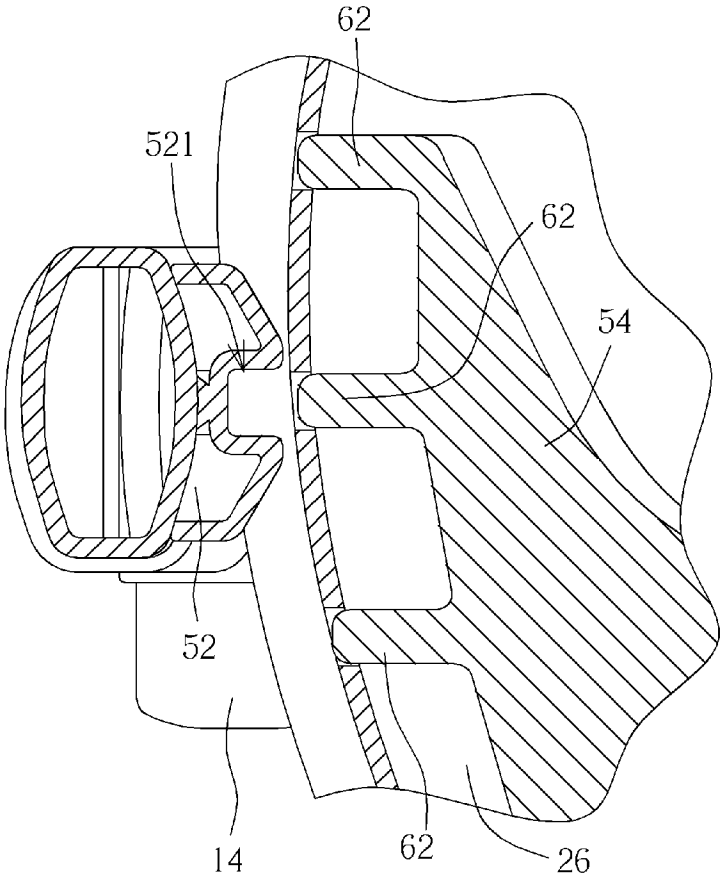
FIG. 10 to FIG. 12 are diagrams of the adjusting mechanism in different modes according to the first embodiment of the present invention.
Figure 10:
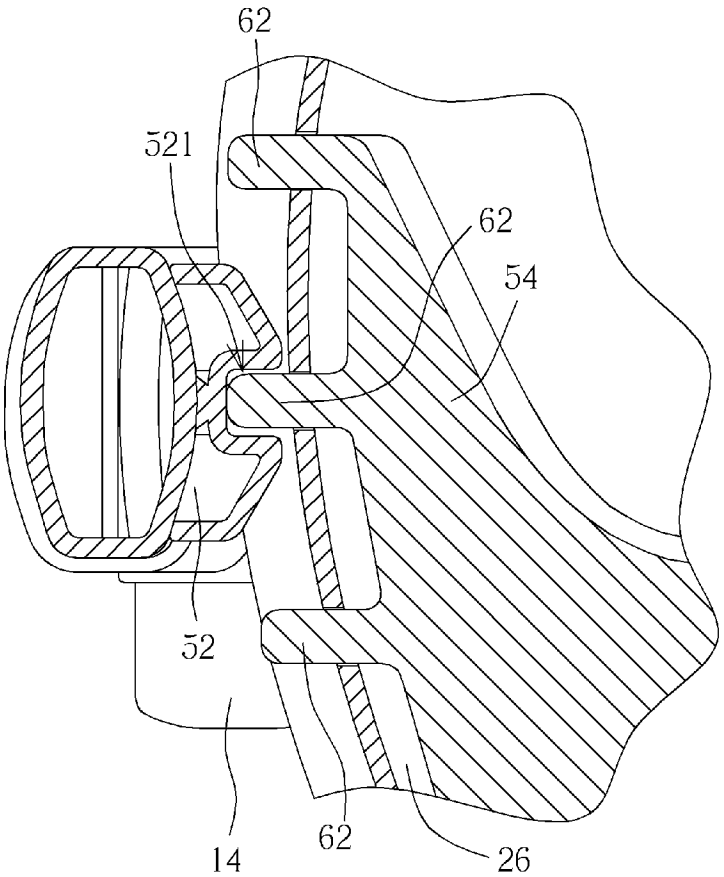
Figure 12:
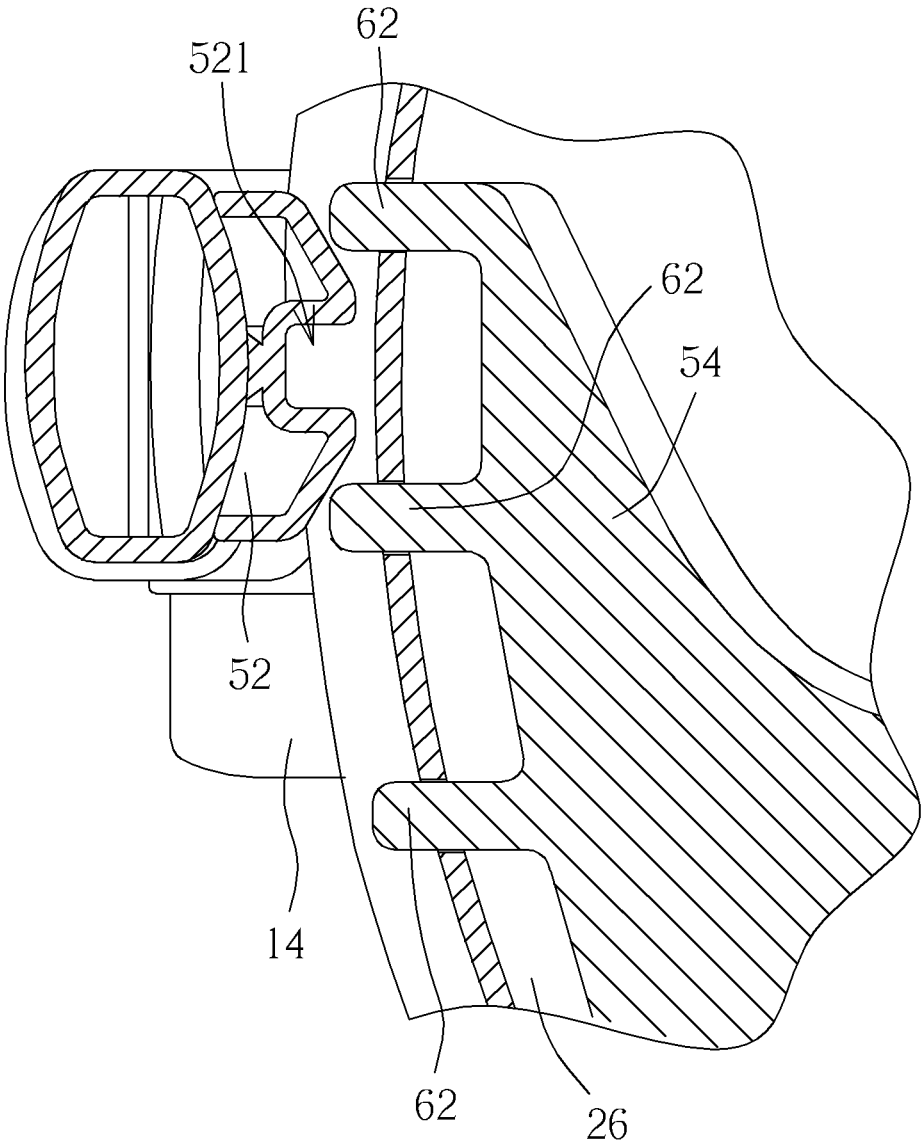

The child carrier 10 further includes an adjusting mechanism 34 disposed between the supporting component 12 and the seating component 24. The seat body 26 can pivot to the upper supporting frame 14 via the adjusting mechanism 34, and an inclined angle of the seating component 24 can be varied by the adjusting mechanism 34. Please refer to FIG. 9 to FIG. 12. FIG. 9 is a sectional view of the adjusting mechanism 34 according to a first embodiment of the present invention. FIG. 10 to FIG. 12 are diagrams of the adjusting mechanism 34 in different modes according to the first embodiment of the present invention. The adjusting mechanism 34 shown in FIG. 9 is suitable for, but not limited to, the seating component 24'. The adjusting mechanism 34 further can be applied to the seating component 24 or any other seat with an inclined adjusting function. As shown in FIG. 9, the adjusting mechanism 34 further includes a first engaging component 52, a second engaging component 54, a resilient component 56, a driving component 58 and a connecting component 60. The first engaging component 52 includes an engaging slot 521 and is disposed on a position far from the seat body 26. The second engaging component 54 includes a plurality of third engaging components 62 and is disposed on a position adjacent to the seat body 26. The third engaging component 62 can be a tooth structure and movably located between the first engaging component 52 and the second engaging component 54 in a switchable manner. The second engaging component 54 drives the third engaging component 62 to move between a first position and a second position. As shown in FIG. 10, the third engaging component 62 is engaged with the engaging slot 521 of the first engaging component 52 since the third engaging component 62 moves to the first position, so as to constrain a relative movement between the seating component 24 and the supporting component 12. As shown in FIG. 11, the third engaging component 62 is disengaged from the first engaging component 52 since the third engaging component 62 moves to the second position, and the seating component 24 can rotate relative to the supporting component 12.

Two ends of the resilient component 56 respectively contact against the seat body 26 and the second engaging component 54. The resilient component 56 can be a tensile spring or a compressive spring to provide a resilient recovering force. Deformation direction of the resilient component 56 is parallel with a moving direction of the second engaging component 54. The external force is applied to the second engaging component 54 to disengage the third engaging component 62 from the first engaging component 52. After the external force is removed from the second engaging component 54, the resilient recovering force of the resilient component 56 can move the second engaging component 54 to an initial position so as to engage the third engaging component 62 with the first engaging component 52. The connecting component 60 can be a wire structure or a resilient piece. Two ends of the connecting component 60 are respectively connected to the driving component 58 and the second engaging component 54. The driving component 58 is movably disposed on the seat body 26 and connected to the second engaging component 54 via the connecting component 60. In the present invention, the user can adjust the inclined angle of the seating component 24 via the driving component 58 by single hand control.

As shown in FIG. 10, the tooth structure of the third engaging component 62 is engaged inside the engaging slot 521 on the first engaging component 52 since the second engaging component 54 moves the third engaging component 62 to the first position, to constrain the relative movement between the seating component 24 and the supporting component 12. The resilient component 56 is utilized to trend the second engaging component 54 toward the first position. For adjusting the inclined angle of the seating component 24', the external force is applied to the driving component 58 to outwardly pull the driving component 58 (such as pulling toward the right side shown in FIG. 9). The driving component 58 moves the second engaging component 54 to the right side via the connecting component 60, and the third engaging component 62 is switched from the first position to the second position. As shown in FIG. 11, the third engaging component 62 is disengaged from the engaging slot 521 since the third engaging component 62 is switched to the second position. Furthermore, as shown in FIG. 12, the seating component 24' can rotate relative to the supporting component 12 via the adjusting mechanism 34 to adjust the inclined angle of the seat body 26, and then another third engaging component 62 (such as the upper third engaging component 62 or the low third engaging component 62) inserts into the engaging slot 521 on the first engaging component 52 to constrain the relative movement between the seating component 24' and the supporting component 12.

Figure 13:
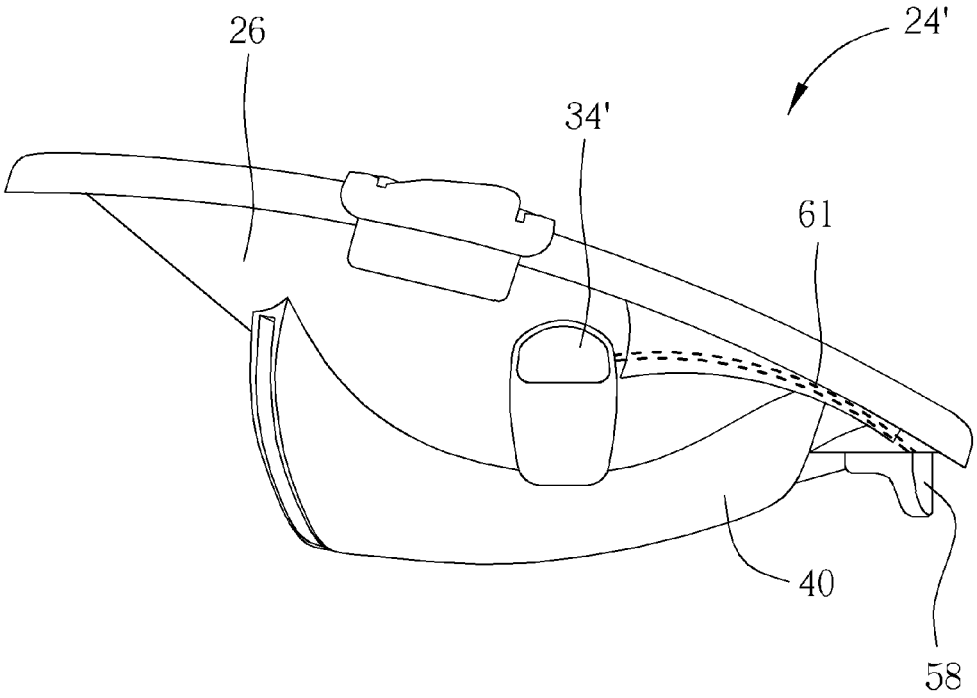
FIG. 13 is a diagram of the adjusting mechanism according to a second embodiment of the present invention.
Figure 14:
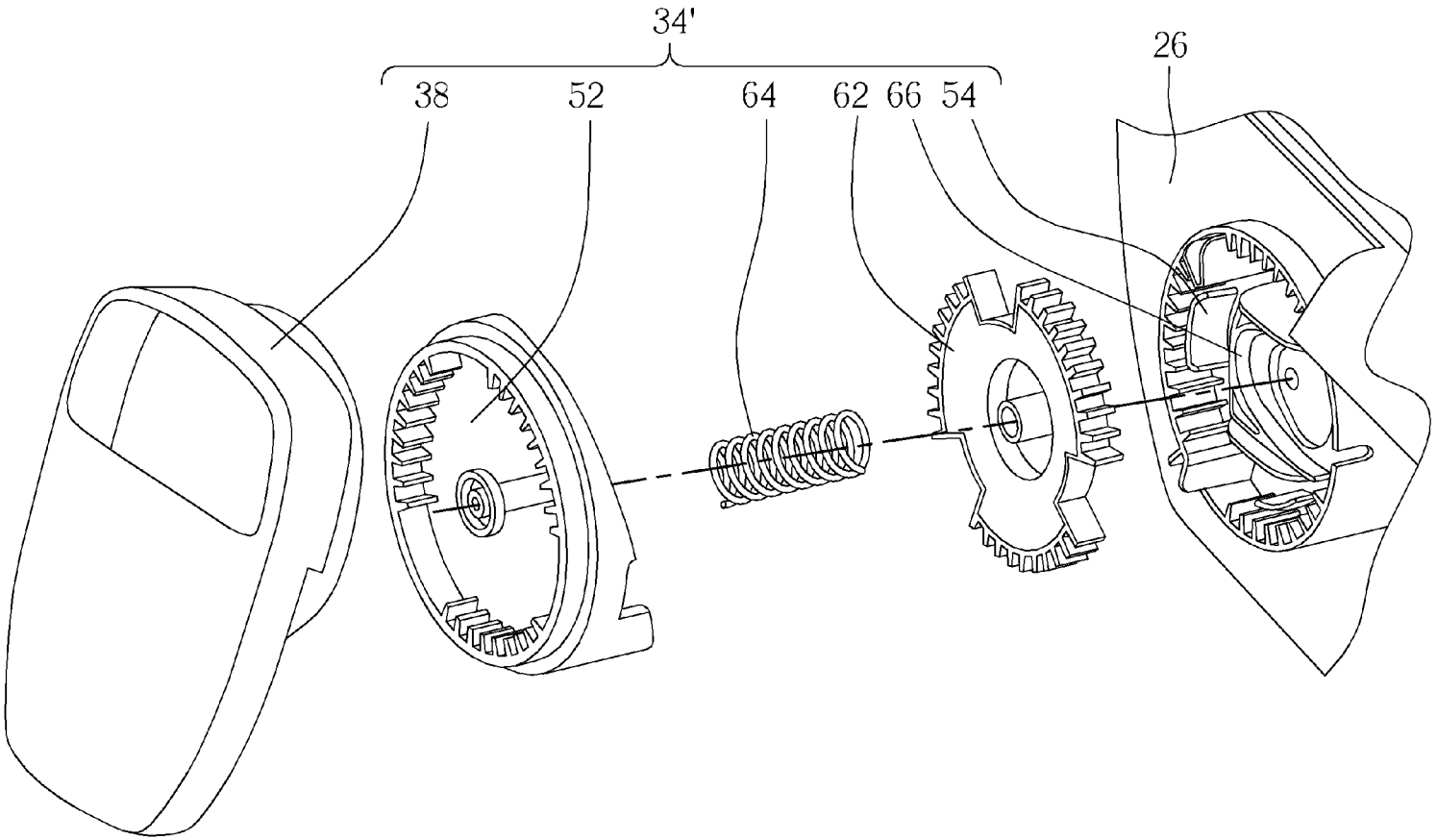
FIG. 14 is an exploded diagram of the adjusting mechanism according to the second embodiment of the present invention.
Figure 15:
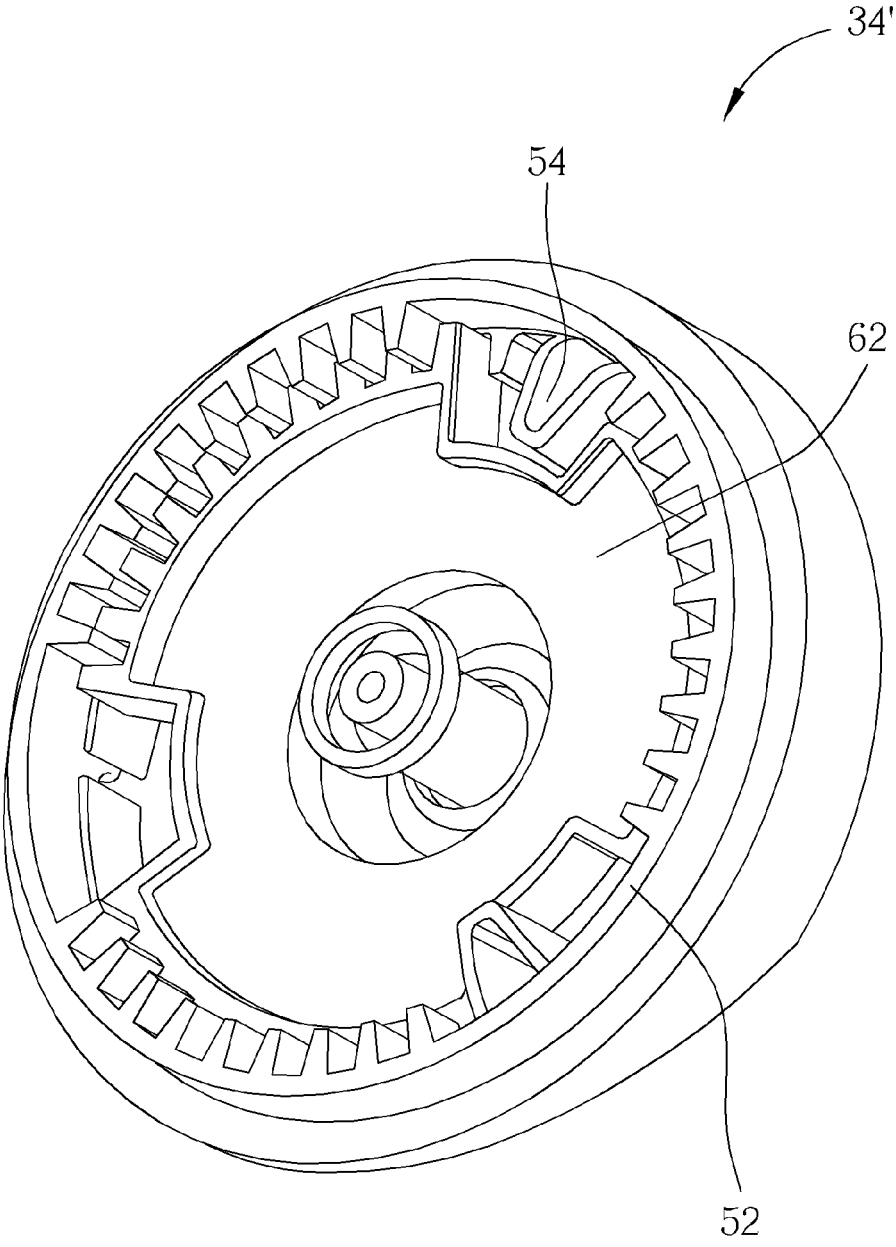
FIG. 15 is a diagram of the adjusting mechanism according to the second embodiment of the present invention.
Figure 16:
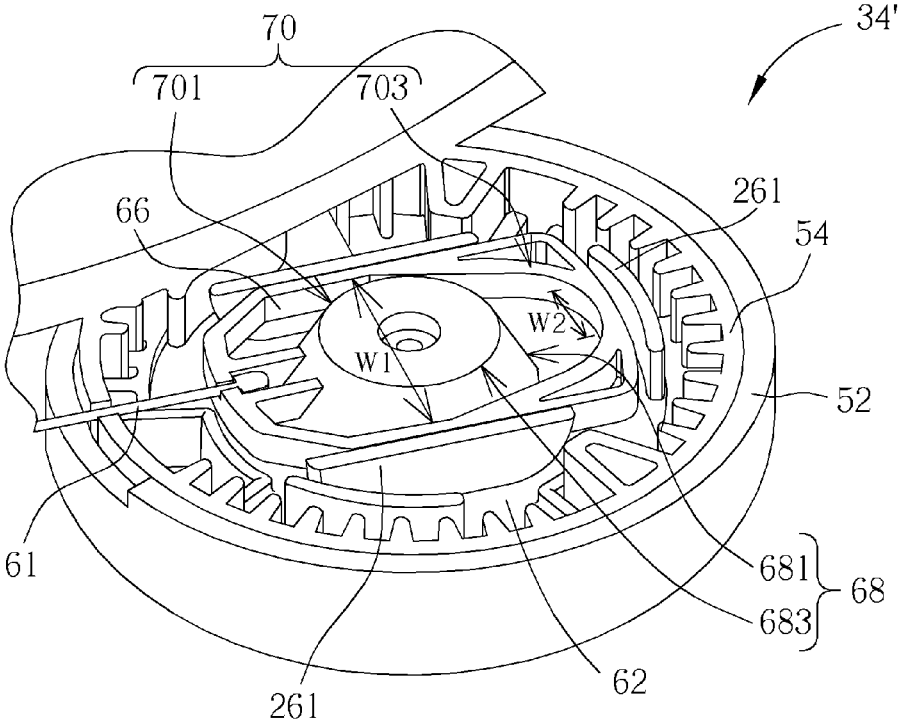
FIG. 16 and FIG. 17 respectively are diagrams of the adjusting mechanism in different modes according to the second embodiment of the present invention.
Figure 17:
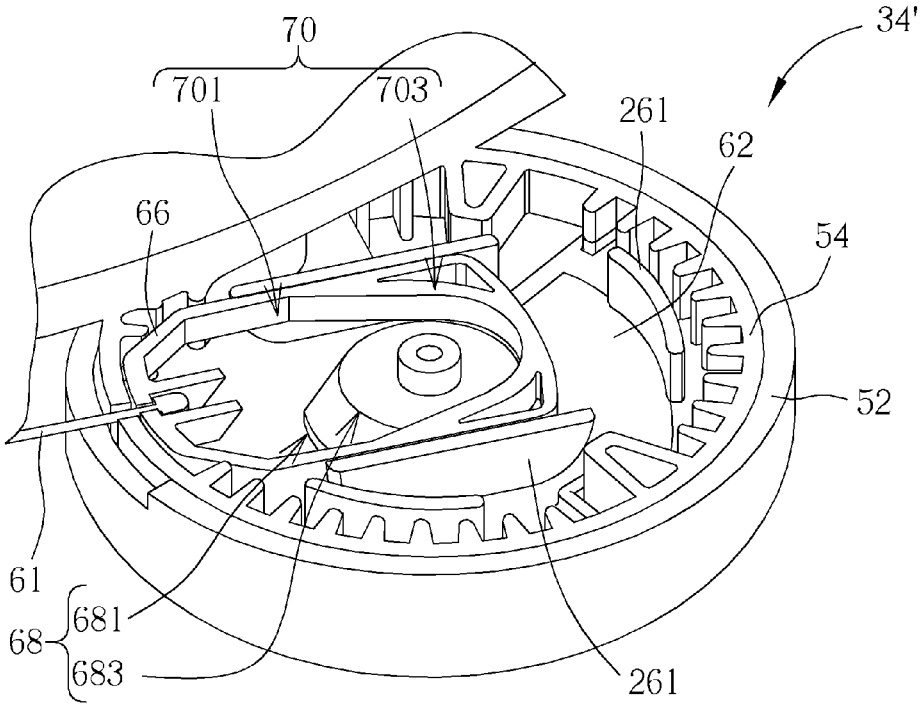
Figure 18:
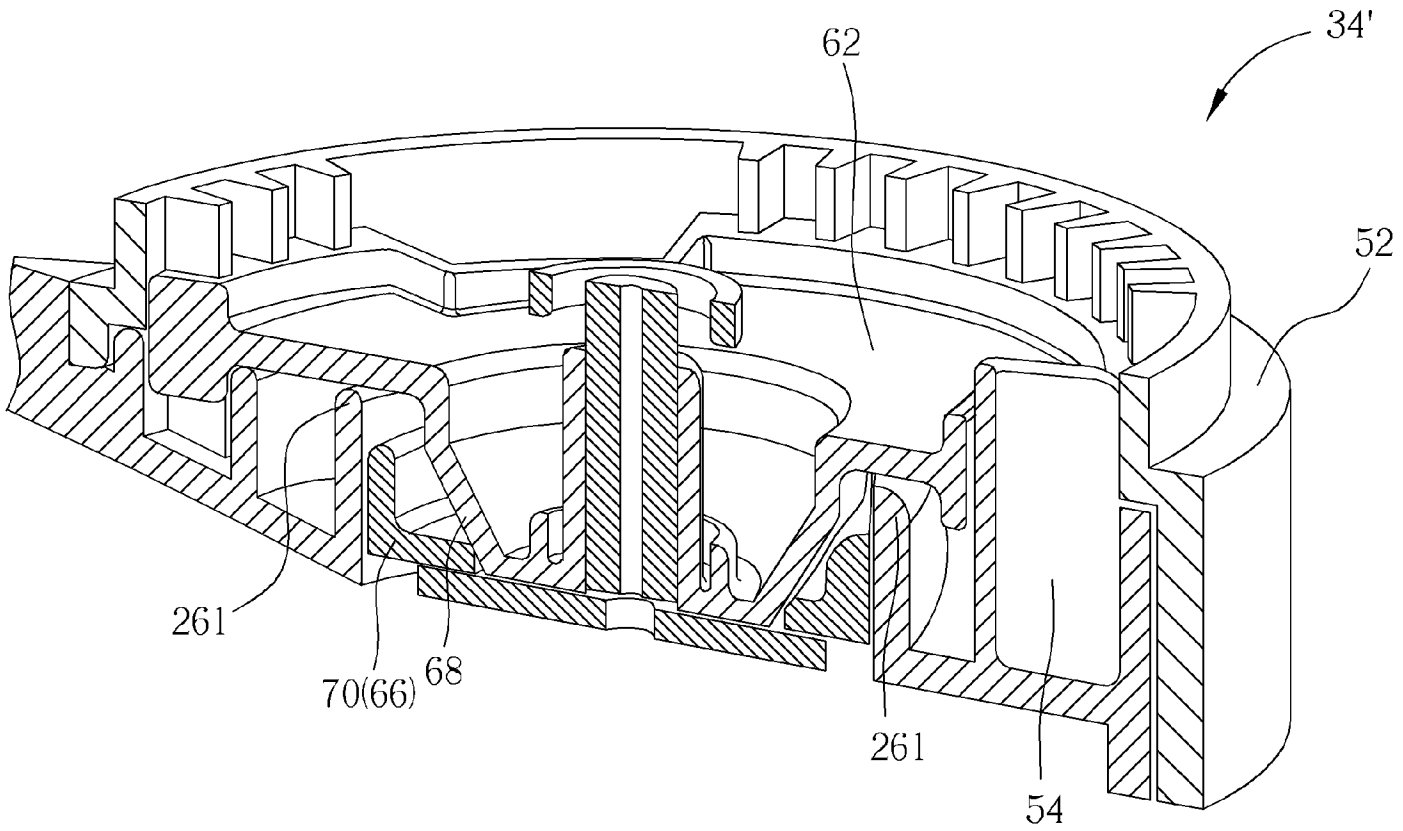
FIG. 18 is a sectional view of the adjusting mechanism shown in FIG. 16.
Figure 19:
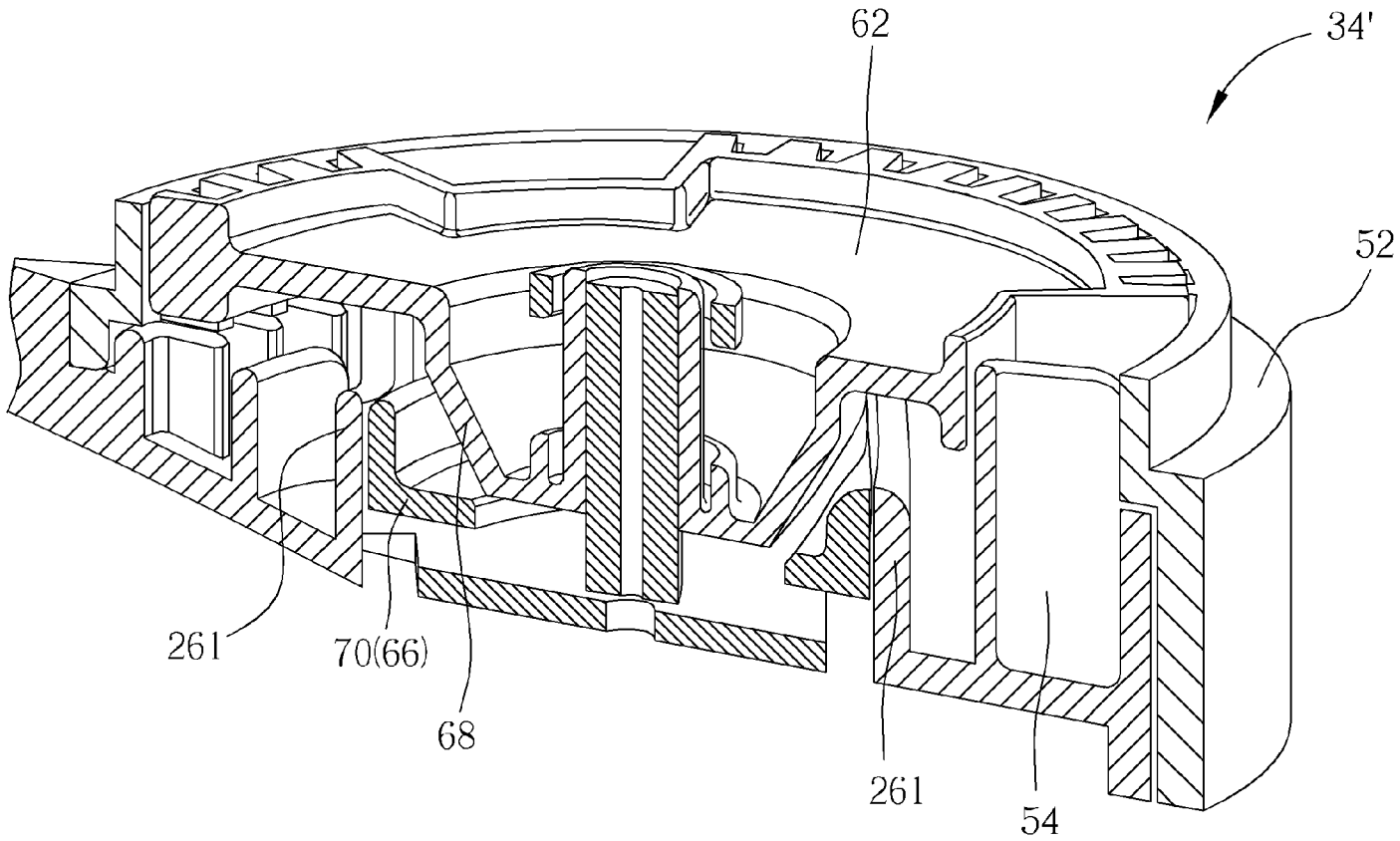
FIG. 19 is a sectional view of the adjusting mechanism shown in FIG. 17.

Please refer to FIG. 13 to FIG. 19. FIG. 13 is a diagram of the adjusting mechanism 34' according to a second embodiment of the present invention. FIG. 14 is an exploded diagram of a part of the adjusting mechanism 34' according to the second embodiment of the present invention. FIG. 15 is a diagram of a part of the adjusting mechanism 34' according to the second embodiment of the present invention. FIG. 16 and FIG. 17 respectively are diagrams of the adjusting mechanism 34' in different modes according to the second embodiment of the present invention. FIG. 18 is a sectional view of the adjusting mechanism 34' shown in FIG. 16. FIG. 19 is a sectional view of the adjusting mechanism 34' shown in FIG. 17.

The adjusting mechanism 34' includes the first engaging component 52, the second engaging component 54, the driving component 58, a cable 61, the third engaging component 62, an elastic component 64 and an actuating component 66. The second engaging component 54 is disposed on the seat body 26. The first engaging component 52 is assembled with the second assembling component 38 to dispose on the upper supporting frame 14. The third engaging component 62 is movably disposed between the first engaging component 52 and the second engaging component 54. The actuating component 66 is slidably disposed between the second engaging component 54 and the third engaging component 62. Two ends of the cable 61 are respectively connected to the driving component 58 and the actuating component 66, so that the driving component 58 can control a movement of the third engaging component 62 via the cable 61 and the actuating component 66. When the driving component 58 is pulled, the actuating component 66 slides relative to the seat body 26 to disengage the third engaging component 62 from the second engaging component 54, and the seating component 24 can rotate relative to the supporting component 12 by the adjusting mechanism 34'. Besides, two ends of the elastic component 64 are respectively connected to the third engaging component 62 and the first engaging component 52. The elastic component 64 can recover the actuating component 66 and the third engaging component 62 to initial positions since the external force applied to the driving component 58 is removed. It should be mentioned that the user can adjust the inclined angle of the seating component 24 via the driving component 58 by single hand control.

The first engaging component 52 and the second engaging component 54 respectively include a first internal tooth structure and a second internal tooth structure, and the third engaging component 62 is a locking gear matched with the first internal tooth structure and the second internal tooth structure accordingly. The locking gear driven by the actuating component 66 is movably disposed between the first internal tooth structure and the second internal tooth structure. The second engaging component 62 includes a cone structure 68. The actuating component 66 includes an inclined guiding structure 70 slidably abutting against the cone structure 68. The inclined guiding structure 70 includes a first end 701 and a second end 703 opposite to each other, and a width W1 of the first end 701 is greater than a width W2 of the second end 703. As shown in FIG. 16 and FIG. 18, the third engaging component 62 moves to the first position, the first end 701 of the inclined guiding structure 70 abuts against a bottom 681 of the cone structure 68, and the third engaging component 62 contacts against constraining walls 261 of the seat body 26. Meanwhile, the third engaging component 62 is simultaneously engaged with the second engaging component 54 and the first engaging component 52. Due to structural interference between the first engaging component 52, the second engaging component 54 and the third engaging component 62, the adjusting mechanism 34' can constrain the relative movement between the seating component 24 and the supporting component 12.

As shown in FIG. 17 and FIG. 19, the driving component 58 is utilized to actuate unlock function of the adjusting mechanism 34', and the inclined guiding structure 70 slides relative to the constraining walls 261 of the seat body 26 to push the cone structure 68. Due to width difference between the ends of the inclined guiding structure 70, the third engaging component 62 moves along a center axial direction of the third engaging component 62 and is switched to the second position; in the meantime, the second end 703 of the inclined guiding structure 70 abuts against a top 683 of the cone structure 68. When the third engaging component 62 is switched to the second position, the locking gear of the third engaging component 62 is engaged with the first internal tooth structure of the first engaging component 52 and separated from the second engaging component 54. Thus, the seating component 24 can rotate relative to the supporting component 12 via the adjusting mechanism 34' to adjust the inclined angle of the seat body 26.

Figure 20:
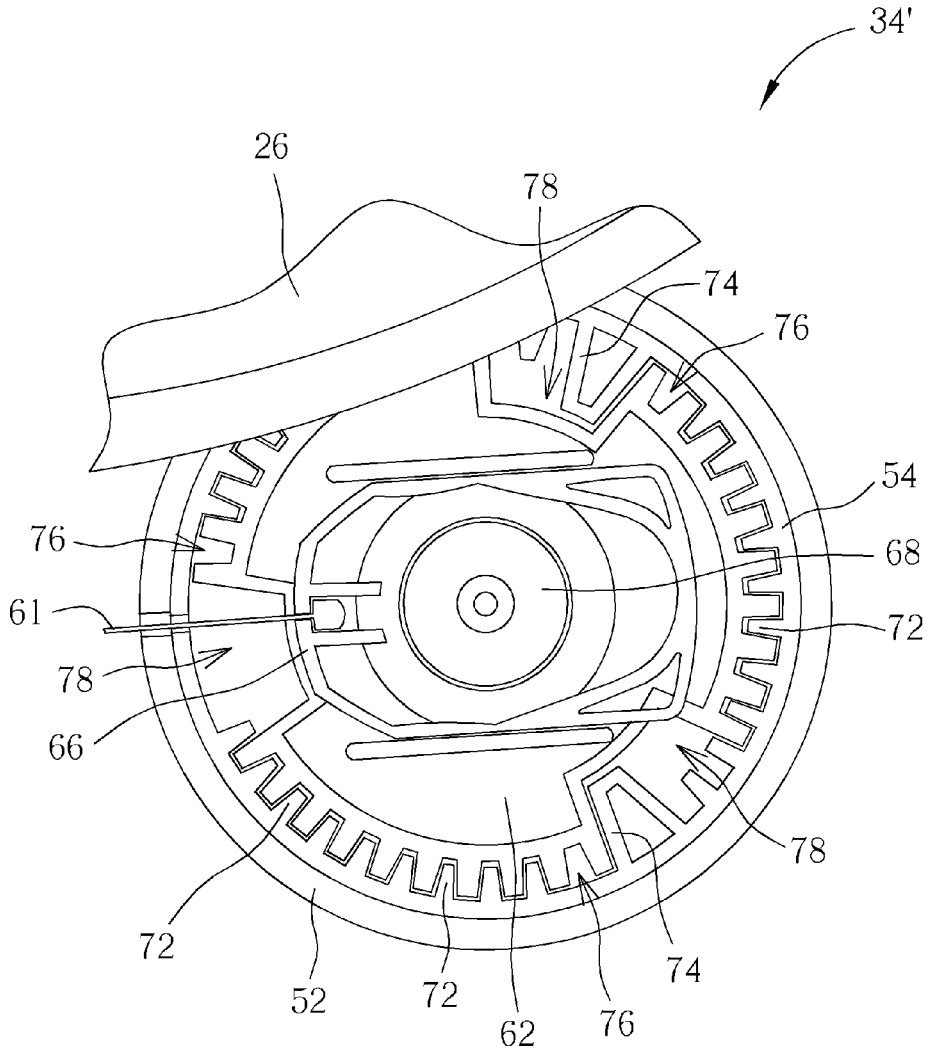
FIG. 20 to FIG. 22 respectively are diagrams of the adjusting mechanism indifferent rotary modes according to the second embodiment of the present invention.
Figure 21:
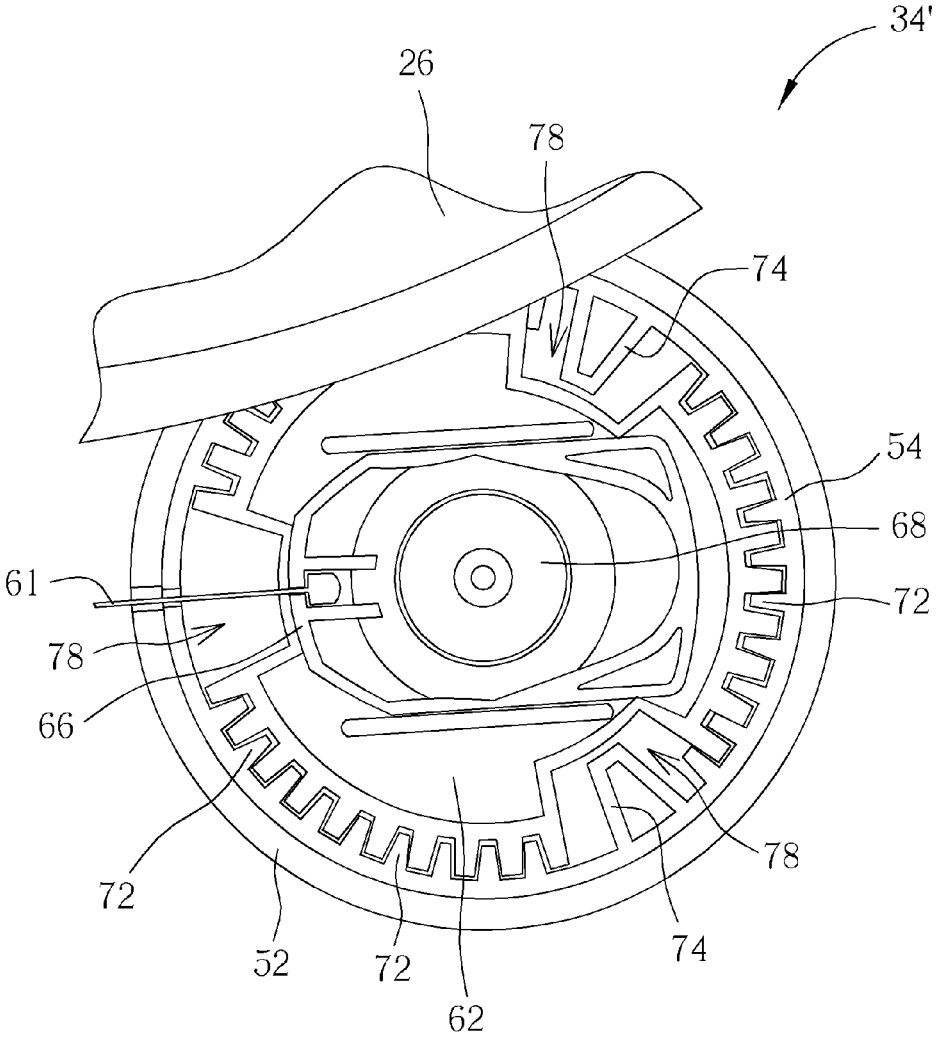
Figure 22:
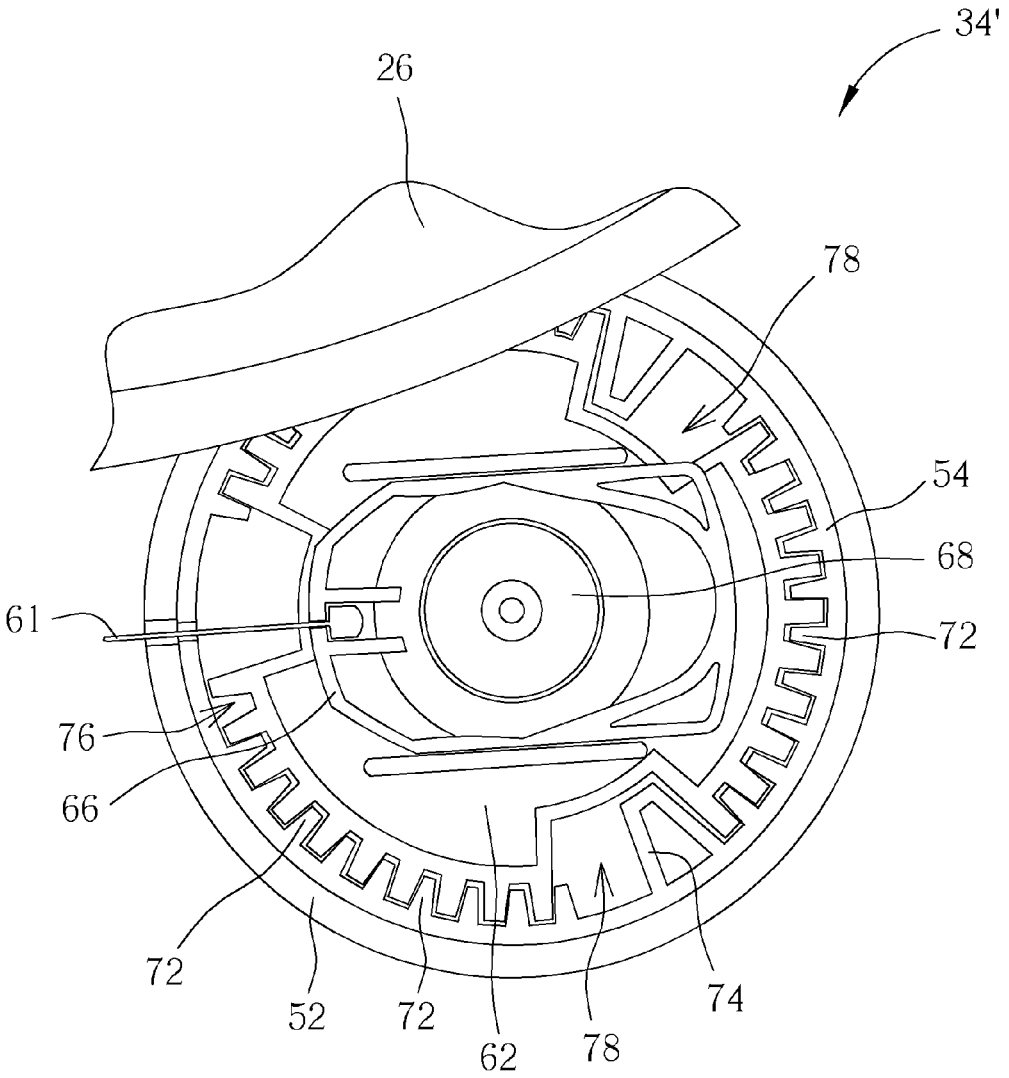

Please refer to FIG. 20 to FIG. 22. FIG. 20 to FIG. 22 respectively are diagrams of the adjusting mechanism 34' in different rotary modes according to the second embodiment of the present invention. The second internal tooth structure of the second engaging component 54 includes a plurality of engaging teeth 72 and a plurality of constraining teeth 74. Each of the constraining teeth 74 is arranged between the adjacent engaging teeth 72. A height of the constraining tooth 74 is greater than a height of the engaging tooth 72. An amount of the constraining tooth 74 is smaller than an amount of the engaging tooth 72, and the second internal tooth structure includes at least one constraining tooth 74. The locking gear of the third engaging component 62 includes a plurality of engaged slots 76 and a plurality of constraining slots 78. Each of the constraining slots 78 is arranged between the adjacent engaged slots 76. A depth and a width of the constraining slot 78 is greater than a depth and a width of the engaged slot 76. An amount of the constraining slot 78 is preferably equal to an amount of the constraining tooth 74. The constraining tooth 74 is movably disposed inside the corresponding constraining slot 78 no matter where the third engaging component 62 is located (such as switching to the first position or the second position). Therefore, the inclined angle of the seating component 24 relative to the supporting component 12 can be adjusted by the adjusting mechanism 34', and a value of the inclined angle is designed according to parameters of the constraining tooth 74 and the constraining slot 78. For example, adjustable variation of the adjusting mechanism 34' becomes more since the third engaging component 62 has the wider width of the constraining slot 78.

Comparing to the prior art, the present invention provides the detachable child carrier. The seating component of the child carrier includes two kinds of seat, such as the toddler seat and the infant seat. The user can assemble the seating component with the supporting component to form the child carrier according to actual demand. The seating component suitable for the toddler can stand on the supporting plane by the foldable feet. The seating component suitable for the infant can be put on the supporting plane by the arc base. The present invention further provides two types of adjusting mechanism. The seating component can stably pivot to the supporting component via the adjusting mechanism, and the adjusting mechanism can be controlled by single hand to easily adjust the inclined angle of the seating component relative to the supporting component. In each embodiment of the present invention, elements having the same numeral as ones of another embodiment have the same structures and functions, and a detailed description it omitted herein for simplicity.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adjusting mechanism applied to a child carrier, the child carrier comprising a supporting component and a seating component, the seating component being adapted to detachably assemble with the supporting component, the adjusting mechanism comprising:

a first engaging component detachably disposed on the supporting component, an engaging slot being formed on the first engaging component;

a second engaging component disposed on the seating component; and a third engaging component movably located between the first engaging component and the second engaging component in a switchable manner, the second engaging component being adapted to drive the third engaging component to move between a first position and a second position, the third engaging component moving to the first position to engage with the first engaging component so as to constrain a relative movement between the seating component and the supporting component, the third engaging component moving to the second position to be separated from the first engaging component so that the seating component rotates relative to the supporting component via the adjusting mechanism, the third engaging component comprising a plurality of tooth structures connected to the second engaging component, and the second engaging component moving the third engaging component to the first position for engaging one of the plurality of tooth structures of the third engaging component with the engaging slot.

2. The adjusting mechanism of claim 1, further comprising:

a resilient component, two ends of the resilient component being respectively connected to a seat body of the seating component and the second engaging component; and a driving component movably disposed on a seat body of the seating component and connected to the second engaging component, the driving component being adapted to move relative to the seating component to drive the second engaging component, so as to switch the third engaging component between the first position and the second position.

3. The adjusting mechanism of claim 2, further comprising:

a connecting component connected between the driving component and the second engaging component, the driving component being adapted to drive the second engaging component via the connecting component.

4. The adjusting mechanism of claim 1, wherein the seating component further comprises a rotary assembly, the rotary assembly comprises a rotating holder, a clamping component and a jointing component, the jointing component is disposed on a lateral side of the seating component, the rotating holder is connected to the jointing component via the clamping component and is suspended over the seating component.

5. The adjusting mechanism of claim 4, wherein the clamping component is made of resilient material, the clamping component comprises a plurality of first constraining portions with annular arrangement, the jointing component comprises a plurality of second constraining portions with annular arrangement, the plurality of first constraining portions is accordingly engaged with the plurality of second constraining portions to adjust relative position between the clamping component and the jointing component.

6. A child carrier comprising:

a supporting component;

a seating component comprising a seat body, the seat body being adapted to detachably assemble with the supporting component; and an adjusting mechanism, comprising:

a first engaging component detachably disposed on the supporting component, an engaging slot being formed on the first engaging component;

a second engaging component disposed on the seat body; and a third engaging component movably located between the first engaging component and the second engaging component in a switchable manner, the second engaging component being adapted to drive the third engaging component to move between a first position and a second position, the third engaging component moving to the first position to engage with the first engaging component so as to constrain a relative movement between the seating component and the supporting component, the third engaging component moving to the second position to be separated from the first engaging component so that the seating component rotates relative to the supporting component via the adjusting mechanism, the third engaging component comprising a plurality of tooth structures connected to the second engaging component, and the second engaging component moving the third engaging component to the first position for engaging one of the plurality of tooth structures of the third engaging component with the engaging slot.

7. The child carrier of claim 6, wherein the adjusting mechanism further comprises a resilient component and a driving component, two ends of the resilient component are respectively connected to the seat body and the second engaging component, and the driving component is movably disposed on the seat body and connected to the second engaging component, and is adapted to move relative to the seat body to drive the second engaging component.

8. The child carrier of claim 7, wherein the adjusting mechanism further comprises a connecting component connected between the driving component and the second engaging component, and the driving component is adapted to drive the second engaging component via the connecting component.

9. The child carrier of claim 6, wherein the seating component further comprises a rotary assembly, the rotary assembly comprises a rotating holder, a clamping component and a jointing component, the jointing component is disposed on a lateral side of the seating component, the rotating holder is connected to the jointing component via the clamping component and is suspended over the seat body.

10. The child carrier of claim 9, wherein the clamping component comprises a plurality of first constraining portions with annular arrangement, the jointing component comprises a plurality of second constraining portions with annular arrangement, the plurality of first constraining portions is accordingly engaged with the plurality of second constraining portions to adjust relative position between the clamping component and the jointing component.

11. The child carrier of claim 9, wherein the clamping component is made of resilient material.

* * * * *